United States Patent [19]

Lane, Jr.

[11] Patent Number: 4,486,649

[45] Date of Patent: Dec. 4, 1984

[54] CONTACT HEATER MOUNTING ASSEMBLY

[75] Inventor: Wendell C. Lane, Jr., Laurinburg, N.C.

[73] Assignee: Dana Corporation, Toledo, Ohio

[21] Appl. No.: 488,451

[22] Filed: Apr. 25, 1983

[51] Int. Cl.[3] ..... H05B 3/06

[52] U.S. Cl. ..... 219/536; 174/117 A; 219/345; 219/535; 219/542; 219/549

[58] Field of Search ..... 219/203, 345, 527, 522, 219/528, 535, 536, 537, 541, 542, 544, 549; 174/117 R, 117 A; 338/210, 212

[56] References Cited

U.S. PATENT DOCUMENTS

| | | | |
|---|---|---|---|
| 2,502,148 | 3/1950 | Grothouse | 219/345 |
| 2,619,580 | 11/1952 | Pontiere | 219/549 X |
| 3,125,657 | 3/1964 | Coltin | 219/535 |
| 3,153,140 | 10/1964 | Theodore et al. | 219/549 |
| 3,168,617 | 2/1965 | Richter | 174/117 R |
| 3,268,846 | 8/1966 | Morey | 338/212 |
| 3,564,207 | 2/1971 | Joeckel | 219/544 |
| 3,655,496 | 4/1972 | Ettre et al. | 174/117 A |
| 3,757,087 | 9/1973 | Bernard | 219/549 |
| 4,058,704 | 11/1977 | Shimizu | 219/528 |
| 4,197,449 | 4/1980 | Fessenden | 219/549 |
| 4,251,712 | 2/1981 | Parr | 219/203 |

FOREIGN PATENT DOCUMENTS

| | | | |
|---|---|---|---|
| 1009732 | 6/1957 | Fed. Rep. of Germany | 219/535 |

*Primary Examiner*—Volodymyr Y. Mayewsky
*Attorney, Agent, or Firm*—Frank B. McDonald

[57] ABSTRACT

A contact heater mounting assembly includes a single rolled flexible sheet which both supports a plurality of heating elements and provides protection for a high cohesion level adhesive on the elements. The assembly thus provides for convenient installation of the elements to a vehicular window glass or other surface to be heated without the need for removal of a separate cover member otherwise utilized for protection of the high level adhesive. In a preferred embodiment, the contact heater mounting assembly is elongate and capable of being rolled into a coiled form. The flexible sheet defines opposed top and bottom surfaces, the top surface carrying a low cohesion level adhesive for supporting a plurality of heating elements, each of which carries a high level adhesive thereon. A plurality of spacers are disposed in pairs, one on either side of each heating element for insuring a gap or spacing between the bottom surface of the sheet and the high level adhesive on each element when said assembly is in coiled form.

7 Claims, 4 Drawing Figures

CONTACT HEATER MOUNTING ASSEMBLY

BACKGROUND OF THE INVENTION

This invention relates to contact heater mounting assemblies which enable resistance heating elements to be adhesively applied to surfaces intended to be heated. More particularly, the invention relates to improvements which facilitate the manufacture and handling of rear window defogger mounting assemblies.

Prior art contact heater mounting units have been rather cumbersome to manufacture and particularly difficult to handle, primarily because of the required protection of adhesive layers having relatively high cohesion levels. Such layers are contained on individual heating elements. For example, one common means of protecting the high level adhesive layer or the so-called "glass mounting" adhesive on each element is a protective cover layer superimposed thereover. The integrity of the high level adhesive layer is extremely critical, because the adhesive must be capable of permanently affixing the heating elements to a mounting surface upon removal of the cover layer. The high level adhesive must have a cohesion which is strong enough to attach the heating element to the glass, yet the cover layer must be capable of being easily removed in the field. For this purpose a release agent such as silicone is generally applied to the cover layer, and thus facilitates its removal.

Physical contact, however, between the cover layer and the high level adhesive creates a major disadvantage in that the release agents employed, such as silicone, tend to migrate into the adhesive and to decrease its cohesion capacity over a period of time. Moreover, a relatively fine balance must be achieved between the cohesive levels of the two adhesives, as the cover layer must separate cleanly from the high level adhesive without prematurely pulling the heating element away from the low level adhesive and hence from a backing or support sheet. Finally, after the heating elements are pressed onto the mounting surface, the low level adhesive must allow release of the backing sheet from the heating elements without pulling the heating elements away from the mounting surface.

A second means of protecting and thus insuring the integrity of the high level adhesive is to provide for a spacing or gap between the surface of the protective cover and the high level adhesive. One means by which this has been accomplished has been the inclusion of undulations in the protective cover layer, whereby portions of the cover layer are spaced from the adhesive on the heating elements. Alternatively, the support contains the undulations, wherein the heating element is recessed into the support layer by amounts sufficient to provide a gap between the cover layer and the high level adhesive. Both of the latter means, however, require special manufacturing and handling techniques, even though they avoid the special problem of migration of release agents. For example, such units cannot be conveniently rolled or coiled, as the layer having the undulations will collapse upon being rolled. The latter will cause the protective layer to come into contact with and to thus damage the high level adhesive layer.

SUMMARY OF THE INVENTION

The contact heater mounting assembly of the present invention avoids the problem of migration of release agents such as silicone into the high level adhesive carried by the heating elements. Moreover, the mounting assembly of this invention does not require a support or cover member containing undulations which are subject to collapse upon coiling.

In a preferred form the assembly includes a flexible support sheet which defines opposed top and bottom surfaces. The top surface of the sheet contains a low level adhesive to which a plurality of heating elements, each containing a high level adhesive on its opposed surfaces, are adhesively attached. Pairs of spacers are also adhesively attached to the top surface, one of each pair positioned along either side of one heating element. Each spacer has a top surface which extends a slight distance above the exposed high level adhesive layer on an adjacent heating element. When the heater mounting assembly is coiled, the bottom surface of the flexible sheet makes contact with the spacers to thus provide for protective gaps between the bottom surface of the sheet and the high level adhesive layers on the elements. Upon uncoiling of the assembly, the high level adhesive layers become exposed for permanent attachment of the heating elements to a window glass or other suitable surface.

DETAILED DESCRIPTION OF A PREFERRED EMBODIMENT

Figure 1:
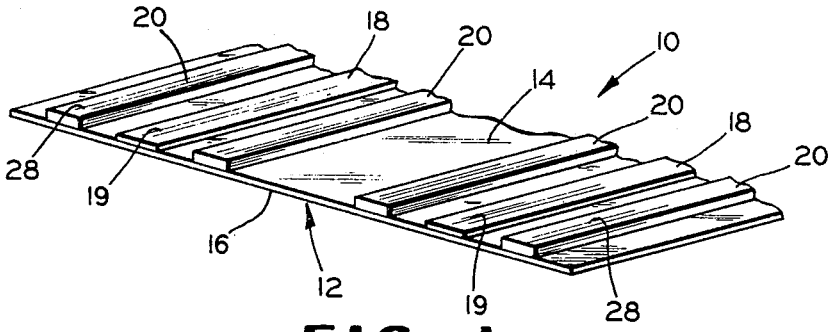
FIG. 1 is a fragmentary perspective view of a preferred embodiment of a contact heater mounting assembly.

Referring first to FIG. 1, a preferred embodiment of a contact heater mounting assembly 10 is shown. The assembly 10 includes a flexible support sheet 12 defining top and bottom surfaces 14 and 16, respectively. A plurality of heating elements 18 are supported on the top surface 14 of the sheet 12 by an adhesive having a relatively low cohesion level as will be further described. Per conventional practice, each heating element 18 contains an adhesive having a high cohesion level, also further described herein, on its otherwise exposed top surface 19.

Positioned in pairs, and supported by the same low level adhesive as are the heating elements 18, spacers 20 are situated on the top surface 14 of the sheet 12; one spacer is positioned immediately adjacent each side of each heating element 18. Each spacer 20 is thicker than its corresponding adjacent heating element 18 for reasons to be described.

Figure 2:
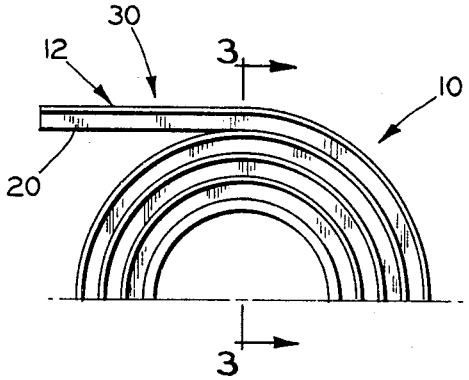
FIG. 2 is a partial side view of the contact heater mounting assembly of FIG. 1, shown in a coiled configuration.

Referring now to FIG. 2, a contact heater mounting assembly 10 constructed in accordance with the present invention is shown in coiled form for transport and handling purposes. It will be appreciated by those skilled in the art that upon the unraveling or uncoiling of the mounting assembly 10, a strip of heater length 30 will be available for application to a mounting surface as desired.

Figure 3:
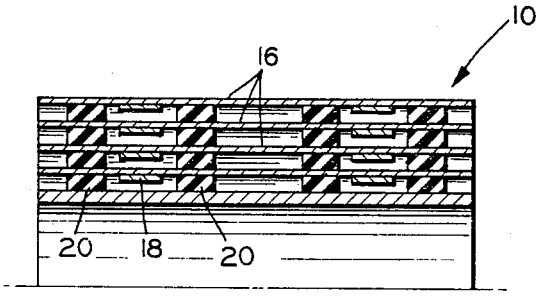
FIG. 3 is a view along lines 3—3 of FIG. 2.

Referring to FIG. 3, a cross-sectional view of the contact heater mounting assembly 10 depicts the positional relationships of the spacers 20, heating elements 18, and flexible support sheet 12 while the assembly is in coiled form. It will be apparent that the greater thickness of the spacers 20 relative to that of the elements will insure a lack of contact between the high level adhesive 24 and the bottom surface 16 of the sheet 12 when the assembly is coiled.

Figure 4:
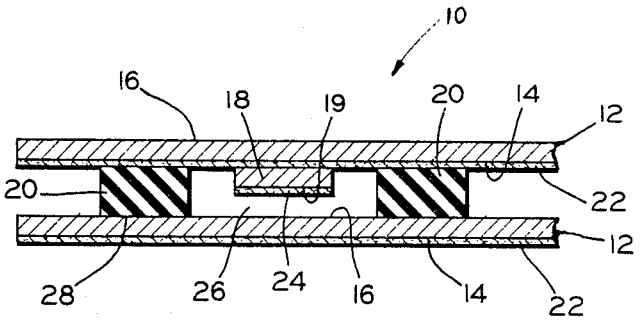
FIG. 4 is an enlarged view of a portion of the sectional view of FIG. 3.

FIG. 4 is a detailed view of a portion of two adjacent layers of the coiled sheet 12, including one heating element 18, and associated spacers 20 on either side of the element. In the preferred embodiment shown, the sheet 12 includes a layer of low level adhesive 22 on its top surface 14. The heating element 18 and the spacers 20 are adhesively attached to the low level adhesive 22. The heating element 18 contains a layer of high level adhesive 24 over its top surface 19. As noted, the spacers 20 are of sufficient thickness relative to the heating element 18, that the top surface 28 of the spacers 20 supports the bottom surface 16 and hence insures a spacing or gap 26 between the adhesive 24 and the bottom surface 16 of an adjacent layer of the coiled sheet 12.

Again, referring back to FIG. 2, as the mounting assembly 10 is uncoiled, the high level adhesive 24 becomes exposed, and a strip of heater length 30 will then be available for direct affixation to a mounting surface. The assembly 10 thus provides a means by which a separate protective cover may be eliminated for covering a high level adhesive layer. The spacers are of a height relative to the individual heating elements that the bottom surface of the support sheet will provide a cover for protecting the high level adhesive while being spaced from actual physical contact with the adhesive. Exposure of the high level adhesive for installation to vehicular window glass or some other desirable member is effected by merely uncoiling the elongate contact heater assembly.

Although the preferred embodiment as herein shown and described provides for the spacers to be adhesively mounted to the top surface 14 of the support sheet 12, the spacers 20 may alternatively be formed as an integral portion of the bottom surface 16 of the support sheet. In such latter embodiment, not shown, as a strip of heater length 30 is uncoiled, only the heating elements 18 are present on the top surface 14 of the support sheet. The latter configuration may be more desirable in certain applications, and is seen to be fully within the scope and spirit of the present invention.

In summary, the invention as herein described avoids an otherwise necessary inclusion of a separate cover layer as a means for protecting the high level adhesive on contact heating elements. Moreover, as the spacer elements of the present invention hold the bottom surface of the support sheet out of contact with the high level adhesive, the problem of release agent migration is entirely eliminated. Finally, because the top surface 28 of the spacers 20 contains no adhesive, the problem of controlling two levels of adhesive so that the heating element will be held to a backing sheet while a protective sheet is pulled away therefrom is also eliminated. These advantages and numerous others will be provided by the structure claimed hereunder.

What is claimed is:

1. An elongate contact heater assembly capable of being rolled into a coiled form, including:

(a) a flexible support sheet defining opposed top and bottom surfaces, said top surface containing a first adhesive;

(b) a heating element comprising top and bottom surfaces, said bottom surface of said element adhesively mated to said top surface of said sheet, said top surface of said element containing a second adhesive having a greater cohesive capacity than said first adhesive; and (c) a pair of spacers positioned between said top and bottom surfaces of said sheet, said spacers secured to said sheet, said heating element positioned laterally interjacent said spacers, said spacers defining a gap between said bottom surface of said sheet and said second adhesive, wherein said bottom surface of said sheet comprises cover means for protection of said second adhesive when said assembly is in coiled form.

2. The assembly of claim 1 wherein said spacers are adhesively mated to said top surface of said sheet.

3. The assembly of claim 2 wherein each spacer comprises a separate unitary structure.

4. The assembly of claim 3 wherein each spacer comprises a rectangular cross-section.

5. The assembly of claim 1 wherein each of said spacers comprises an integral portion of said sheet.

6. The assembly of claim 4 wherein said sheet contains a plurality of heating elements defining parallel flat elongate strips, and wherein said spacers are arranged in parallel pairs, one on each side of each of said heating elements.

7. An elongate contact heater assembly capable of being rolled into a coiled form, comprising:

(a) a flexible support sheet defining top and bottom surfaces, said top surface containing a first adhesive;

(b) a plurality of heating elements each having a pair of opposed surfaces, one surface adhesively mated to said top surface of said sheet, the other surface containing a second adhesive having a greater cohesive capacity than said first adhesive; and (c) a plurality of spacers adhesively mated to said top surface of said sheet, each spacer positioned to one side of an adjacent heating element and having a thickness greater than the combined thickness of said adjacent heating element and said second adhesive contained thereon; whereby when said assembly is in coiled form, said spacers prevent said bottom surface of said sheet from making physical contact with said second adhesive.

* * * * *